United States Patent [19]

Nakatsu

[11] 4,429,297

[45] Jan. 31, 1984

[54] VARIABLE RESISTOR

[75] Inventor: Yoshiyuki Nakatsu, Osaka, Japan

[73] Assignee: Murata Manufacturing Co., Ltd., Japan

[21] Appl. No.: 278,362

[22] Filed: Jun. 29, 1981

[30] Foreign Application Priority Data

Jul. 3, 1980 [JP] Japan ..... 55-91575

[51] Int. Cl.[3] ..... H01C 10/32

[52] U.S. Cl. ..... 338/162; 338/174; 338/325; 338/184

[58] Field of Search ..... 338/162, 163, 160, 174, 338/184, 188, 197, 322, 325; 29/610 R, 621

[56] References Cited

U.S. PATENT DOCUMENTS

| | | | |
|---|---|---|---|
| 3,132,321 | 5/1964 | Kuhlman | 338/174 |
| 3,354,418 | 11/1967 | Casey et al. | 338/163 X |
| 4,184,140 | 1/1980 | Frey, Jr. et al. | 338/163 X |
| 4,210,896 | 7/1980 | Van Benthuysen | 338/163 X |

*Primary Examiner*—C. L. Albritton

*Attorney, Agent, or Firm*—Ostrolenk, Faber, Gerb & Soffen

[57] ABSTRACT

An improved variable resistor for use in electrical and electronic equipment which includes a substrate having fixed side terminals integrally molded in it so that forward end portions of the fixed side terminals are exposed to the surface of the substrate, a resistant layer formed on the surface of the substrate so as to cover the exposed forward end portions of the fixed side terminals at opposite end portions of the resistant layer, a variable side terminal provided on the substrate, and a slider movably disposed on the substrate for sliding movement over the resistant layer so as to adjust resistance of the variable resistor and in which the fixed side terminals are applied with solder coating at their predetermined portions except for the exposed forward end portions.

16 Claims, 12 Drawing Figures

VARIABLE RESISTOR

BACKGROUND OF THE INVENTION

The present invention generally relates to an electrical resistor and more particularly, to a variable resistor having a resistant base plate or substrate formed by molding of resin material and terminal members integrally molded in said substrate.

Variable resistors, especially those of small sizes are widely employed in various electrical and electronic equipment and devices, for example, compact radio and TV sets, VTR, audio set, etc., and there has been an increasing demand for such variable resistors which are highly reliable in performance and yet, can be readily manufactured on a large scale through simple processings.

Generally, the variable resistors of the above described type includes a base plate or substrate integrally molded with terminal members which are arranged to be exposed, in the vicinity of forward ends thereof, to the surface of the substrate, a resistant film or resistant layer formed on the surface of said substrate so as to cover the exposed portions of said terminal members, and a contactor or slider movably mounted on said substrate for sliding movement over the resistant layer to adjust the resistance value. The terminal members for the variable resistor of the above described type are required to have a sufficient solderability for mounting the variable resistor onto a printed circuit board, etc. as in other types of variable resistors, and are generally constituted by a metallic material, for example, brass and the like, with a precious metal such as silver, etc. being plated thereon. Although the terminal members plated by the precious metal as described above are superior in characteristics, not being readily subjected to oxidation, with a high electrical conductivity, there has been such a disadvantage that the high cost of the plating material employed runs counter to the recent trend to save precious metal materials. Accordingly, in the similar method as in the other types of variable resistors, it may be conceived to replace the terminal members plated with the precious metal, by those plated, for example, with solder of Sn-Pb alloy. In connection with the above, as a result of various performance tests made by the present inventor on sample variable resistors which are actually prepared with the employment of resistant substrates of resin material having solder-plated terminal members integrally molded therein, it was noticed in a certain special test that the resistant layer was slightly raised or floated at its portion covering the exposed portions of the terminal members so as to be readily separated or peeled off thereat. Based on the results of experiments conducted from various angles, it has been concluded that the phenomenon as described above is attributable to the fact that, since the temperature for baking the resistant layer to the substrate is arranged to be higher than a melting point of plated solder layer, the solder is melted during the baking of the resistant layer, and thus, the resistant layer is undesirably raised through the molten solder. Therefore, the rising or floating of the resistant layer may be prevented by lowering the baking temperature through proper selection of material for the resistant layer, but even in the above case, similar disadvantage was encountered during soldering for attaching the variable resistor to a printed circuit board or the like. The inconvenience as described above may be ascribed to the phenomenon that, due to the conduction of heat during soldering to the exposed portions of the terminal members through the metallic material of said terminal members, the solder for plating in such portions is undesirably melted, but such drawbacks as described above can not be solved by the selection of metallic materials for the terminal members, etc.

SUMMARY OF THE INVENTION

Accordingly, an essential object of the present invention is to provide an improved variable resistor which employs terminal members applied with an inexpensive solder-plating or coating which is free from undesirable rising of a resistant layer during its manufacture and mounting thereof onto a printed circuit board or the like.

Another important object of the present invention is to provide an improved variable resistor of the above described type which is simple in construction and reliable in functioning, and can be readily manufactured on a large scale at low cost.

In accomplishing these and other objects according to one preferred embodiment of the present invention, there is provided a variable resistor for use in electrical and electronic equipment which comprises a substrate having a pair of fixed side terminal members integrally molded therein so that forward end portions of the fixed side terminals are exposed to one surface of the substrate, a resistant layer formed on the one surface of the substrate so as to cover the exposed forward end portions of the fixed side terminals at opposite end portions of the resistant layer, a variable side terminal member provided on the substrate, and a slider movably disposed on the substrate and electrically connected to said variable side terminal member for sliding movement over the resistant layer so as to adjust resistance of the variable resistor, and which is characterized in that the fixed side terminal members is applied with solder coating or layer at their predetermined portions except for the exposed forward end portions thereof.

By the arrangement according to the present invention as described above, an improved variable resistor free from undesirable rising or floating of the resistant layer has been advantageously provided through simple construction and at low cost, without employment of expensive precious metals, with substantial elimination of disadvantages inherent in the variable resistors of this kind.

BRIEF DESCRIPTION OF THE DRAWINGS

These and other objects and features of the present invention will become apparent from the following description taken in conjunction with the preferred embodiment thereof with reference to the accompanying drawings in which.

Before the description of the present invention proceeds, it is to be noted that like parts are designated by like reference numerals throughout several views of the accompanying drawings.

DETAILED DESCRIPTION OF THE INVENTION

Figure 1A:
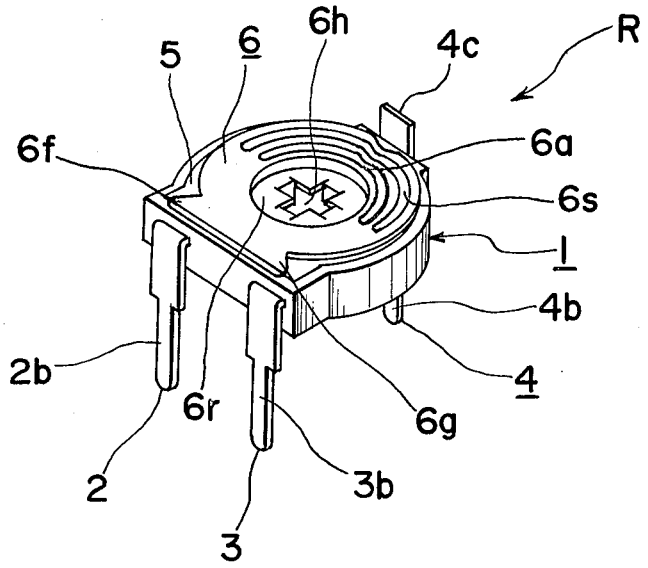
FIG. 1(*a*) is a perspective view of a finished product of a variable resistor according to one preferred embodiment of the present invention, FIG. 1(*b*) is a view similar to FIG. 1(*a*), which particularly shows the state thereof, with its slider removed for clarity, FIG. 1(*c*) is a view similar to FIG. 1(*b*), which particularly shows the state thereof, with its resistant layer further removed for clarity, FIG. 1(*d*) is a fragmentary sectional view showing, on an enlarged scale, a fixed side terminal embedded portion of a substrate employed in the arrangement of FIG. 1(*a*), FIG. 1(*e*) is a side sectional view of the substrate employed in the variable resistor of FIG. 1(*a*), showing a variable side terminal embedded portion thereof, FIGS. 2(*a*) and 2(*b*) are perspective views of terminal frames explanatory of the process for manufacturing the variable resistor of FIG. 1(*a*)
Figure 1B:
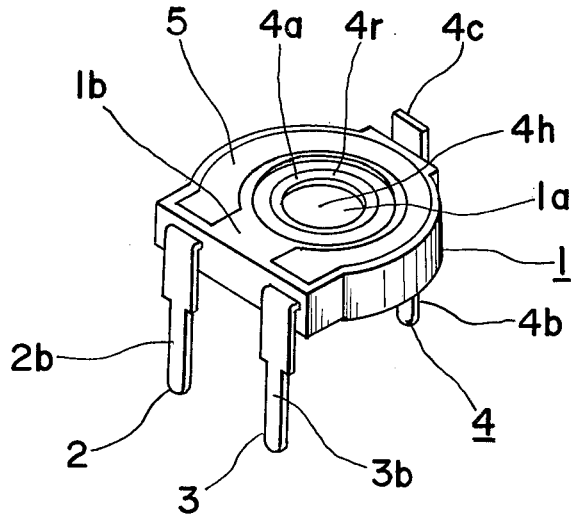
Figure 1C:
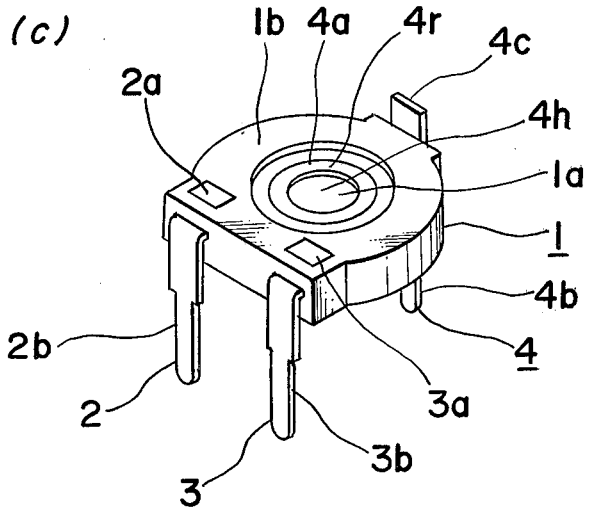
Figure 1D:
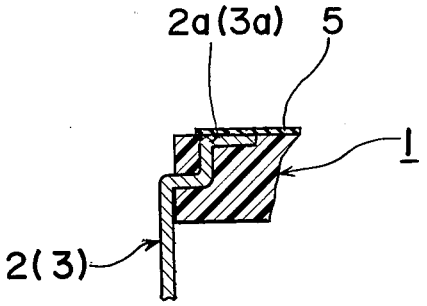
Figure 1E:
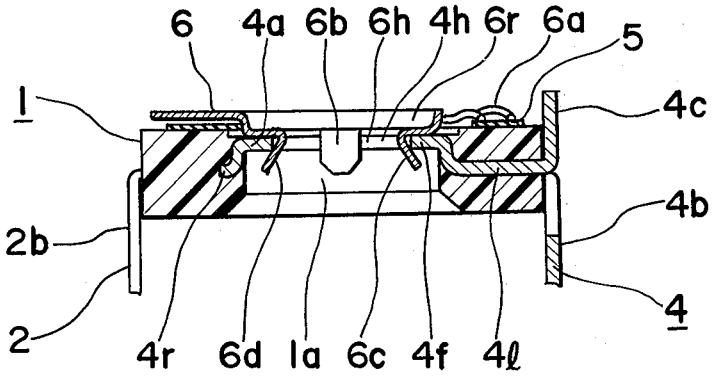

Referring now to the drawings, there is shown in FIG. 1 a variable resistor R according to one preferred embodiment of the present invention which generally includes a base plate or substrate 1 of an approximately circular disc-like configuration made, for example, of electrically insulative resin material such as epoxy resin or the like, and having an insertion opening 1*a* (FIGS. 1(*b*), 1(*c*) and 1(*e*)) which is formed at a central portion thereof, fixed side terminal members 2 and 3 and a variable side terminal member 4 each embedded, at its one portion, in the substrate 1 for being secured therein, an arcuate resistant film or resistant layer 5 provided on the surface of the substrate 1 for connecting the fixed side terminal members 2 and 3, and a contactor or slider 6 movably provided on the substrate 1 for sliding movement over the resistant layer 5.

Each of the fixed side terminal members 2 and 3 made of strips of metal such as brass, iron, etc. is folded in direction opposite to each other at two portions adjacent to the end portion thereof as shown in FIG. 1(*d*), and these terminal members 2 and 3 are preliminarily embedded in the substrate 1 through insert-molding except for their terminal portions 2*b* and 3*b* when said substrate 1 is to be molded, in such a method that the surfaces of the end portions 2*a* and 3*a* (FIG. 1(*c*)) thereof are exposed to the surface 1*b* of the substrate 1. Moreover, the terminal members 2 and 3 are covered with solder layers, for example, of Sn-Pb alloy at least at their terminal portions 2*b* and 3*b* except for the portions 2*a* and 3*a* thereof exposed to the surface 1*b* of the substrate 1. Meanwhile, the variable side terminal 4 includes a strip portion 4*l* and an annular portion 4*r* (FIGS. 2(*a*) and 2(*b*)) continuously extending from the strip portion 4*l* and having a raised disc-like portion 4*f* which is provided, at its flat portion 4*a*, with a central opening 4*h* concentric with the insertion opening 1*a* of the substrate 1 (FIG. 1(*e*)). The strip portion 4*l* is formed with a terminal portion 4*b* extending from its end remote from the annular portion 4*r* and a stopper portion 4*c* formed by cutting and raising part of said strip portion 4*l*. The variable side terminal 4 made of a metallic plate such as brass or iron plate and the like is formed with a solder layer, for example, of Sn-Pb alloy applied onto an entire surface thereof, and is embedded in the substrate 1 through insert-molding except for the terminal portion 4*b* during molding of said substrate 1, in such a manner that, at least the inner edge of the central opening 4*h* in the flat portion 4*a* of the annular portion 4*r* extends, to a certain extent, into the insertion opening 1*a* of the substrate 1 in a position spaced a predetermined distance from the surface 1*b* of said substrate 1.

The arcuate resistant layer 5 of carbon material is applied onto the substrate 1 through baking so as to cover, at its opposite ends, the exposed portions 2*a* and 3*a* of the fixed side terminal members 2 and 3.

The variable resistor R further includes the slider 6 of a generally disc-like shape having arcuate slits 6*s* (FIG. 1(*a*)) formed at part of its peripheral portion, which is curved to provide protrusions for a contact 6*a* (FIG. 1(*a*)). The central portion of the slider 6 is provided with a circular recess 6*r* (FIGS. 1(*a*) and 1(*c*)) in which a cross-shaped opening 6*h* is formed, while four tongue pieces 6*b*, 6*c*, 6*d* and 6*e* (FIG. 1 (tongue piece 6*e* is not shown)) are formed to extend from each side edge of said opening 6*h*. The slider 6 is also provided, in positions remote from the contact 6*a*, with a pair of stopper pieces 6*f* and 6*g* (FIG. 1(*a*)) which are arranged to come into contact with the stopper 4*c* for the variable side terminal member 4 upon rotation of said slider 6. The slider 6 as described above is mounted on the substrate 1 so that the contact 6*a* is positioned on the resistant layer 5, and the four tongue pieces 6*b*, 6*c*, 6*d* and 6*e* are folded or staked at the inner peripheral edge of the opening 4*h* in the flat portion 4*a* of the variable side terminal member 4 for permitting the slider 6 to rotate with respect to the substrate 1. In the above case, the circular recessed portion 6*r* of the slider 6 may be directly placed on the flat portion 4*a* of the annular portion 4*r* or it may be disposed directly on the substrate 1 or placed to stride over the flat portion 4*a* of the annular portion 4*r*.

According to the foregoing embodiment of the present invention, although the heat during soldering is conducted to the exposed portions 2*a* and 3*a* through the terminal portions 2*b* and 3*b* of the fixed terminal members 2 and 3 when the variable resistor R is soldered to a printed circuit board and the like, there is no adverse effect to the resistant layer 5, since the exposed portions 2*a* and 3*a* are not applied with the solder layer. Accordingly, even without employment of precious metal, uniform and close adhesion of the resistant layer 5 with respect to the terminal members 2 and 3 is achieved at all times, irrespective of the process of the heat conduction. Moreover, in association with the favorable close adhesion of the resistant layer with respect to the terminal members 2 and 3 as described above, it becomes unnecessary to pay particular attention to the baking temperature of the resistant layer 5 during manufacture. Furthermore, for assembling the variable resistor of the present invention, since it is only required to stake the slider 6 to the substrate 1, mass-productivity thereof has been markedly improved.

Hereinbelow, the method of manufacturing the variable resistor according to the present invention will be described, mainly with reference to its process for avoiding application of the solder layer to the exposed portions 2*a* and 3*a* of the terminal members 2 and 3 on the surface 1*b* of the substrate 1.

Figure 2A:
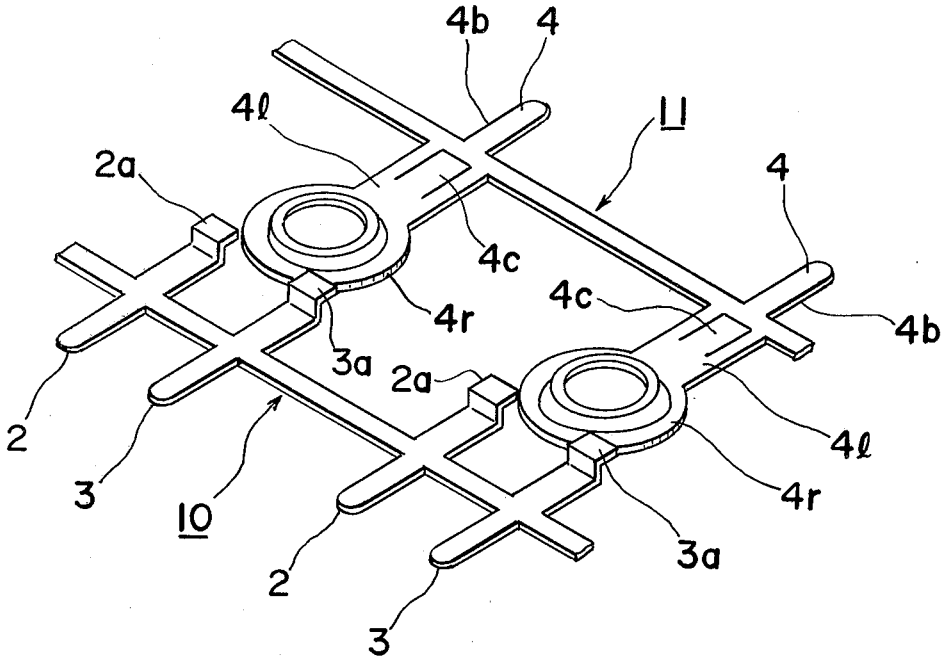
Figure 2B:
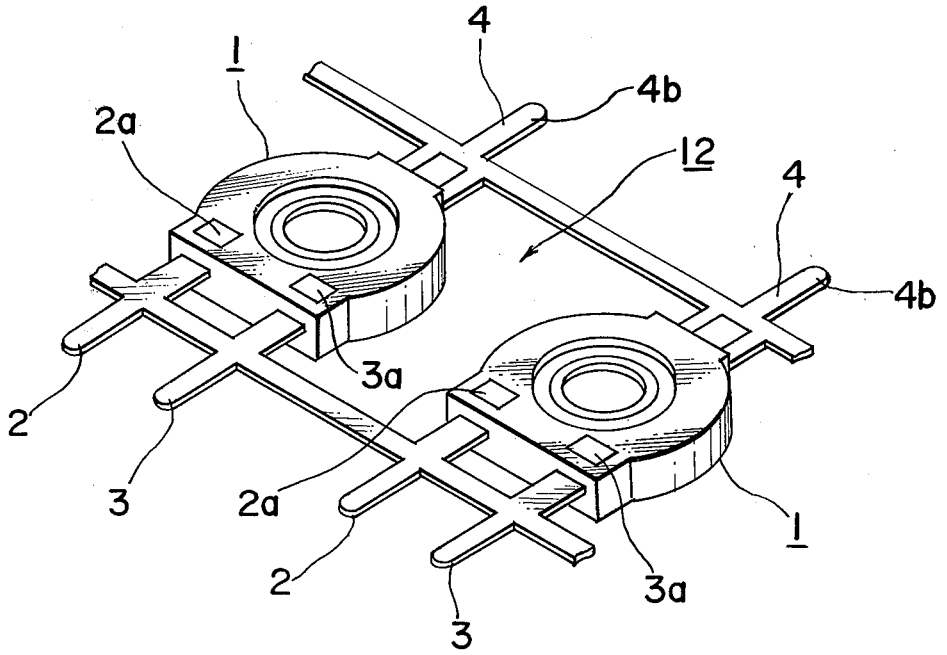

Referring to FIG. 2(*a*), there are shown a variable side terminal frame 11 and a fixed side terminal frame 10 each formed by blanking and shaping of metallic plates of brass, iron or the like preliminarily solder-plated, so as to provide a plurality of the variable side terminal members 4 and fixed side terminal members 2 and 3 which are connected to each other as shown. The annular portions 4*r* of the variable side terminal members 4 and the end portions 2*a* and 3*a* of the terminal members 2 and 3 for the terminal frames 11 and 10 are subjected to the insert-molding with resin material such as epoxy resin so as to prepare a frame 12 having a plurality of molded substrates 1 with the terminal members 4 and 2 and 3 embedded therein as shown in FIG. 2(*b*). In the above state, the surface of each of the substrates 1 is ground or polished either simultaneously or separately for removing the solder layers applied to the exposed portions 2*a* and 3*a* of the terminal members 2 and 3 so as to expose the metallic material thereof. Onto the surfaces of the substrates 1 thus polished, carbon is applied in a predetermined configuration to form the resistant layers 5 (FIG. 1(*b*) thereon through baking. Subsequently, the sliders 6 (FIG. 1(*a*)) connected to each other in a frame-like configuration (not particularly shown) are placed on the resistant layers 5 formed on the substrates 1, and after staking the tongue pieces 6*b*, 6*c*, 6*d* and 6*e* of each of the sliders 6 to the peripheral inner edge of the corresponding opening 4*h* of the variable side terminal member 4, the terminal frames 10 and 11 are cut off at predetermined places to provide the individual variable resistors R as shown in FIG. 1(*a*).

The method of manufacturing the variable resistors R as described above may be modified in various ways as explained hereinbelow with reference to FIGS. 3 through 7.

Figure 3:
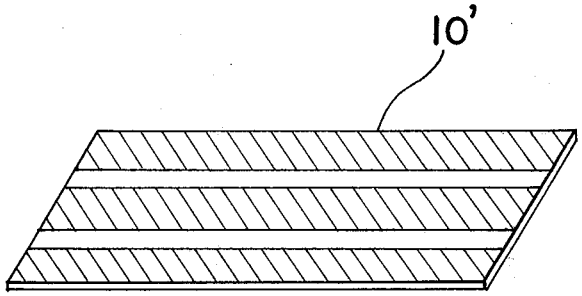
FIGS. 3, 4 and 5 are perspective views of terminal strips to be formed into the terminal members of the variable resistor of FIG. 1(*b*), which are explanatory of modified processes for manufacturing the variable resistor of FIG. 1(*a*)

In one modification as shown in FIG. 3, after subjecting the terminal strip 10' of brass, iron and the like for constituting the terminal frame to the solder-plating, the portions thereof which finally form the terminal exposed portions 2*a* and 3*a* (represented by hatched portions) are ground or polished to remove the solder thereat, before blanking and shaping of the metal strip 10'. Alternatively, the terminal strip 10' may be subjected to a "stripe" solder-plating except for the strip portions (represented by the hatched portions) which finally form the terminal exposed portions, during application of the solder-plating.

Figure 4:
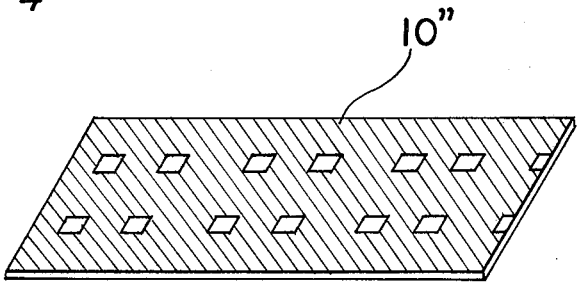

In another modification as illustrated in FIG. 4, the terminal strip 10'' is subjected to a "partial" solder-plating except for the terminal exposed portions (represented by hatched portions).

Figure 5:
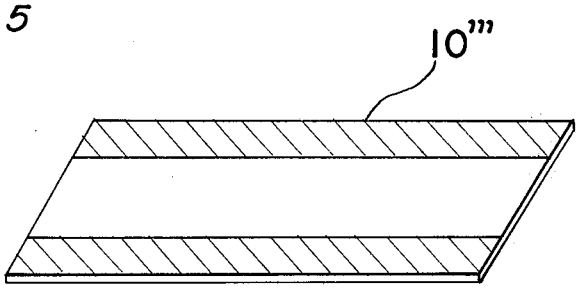

In a still another modification as shown in FIG. 5, before blanking and shaping, opposite sides of the terminal strip 10''' are subjected to solder dipping (represented by hatched portions) so as to form the respective dipped portions into the terminal members of the fixed and variable terminal sides.

Since the terminal strips 10', 10'' and 10''' treated as above may be processed in the similar manner as described with reference to FIGS. 2(*a*) and 2(*b*), detailed description thereof is abbreviated here for brevity.

Figure 6:
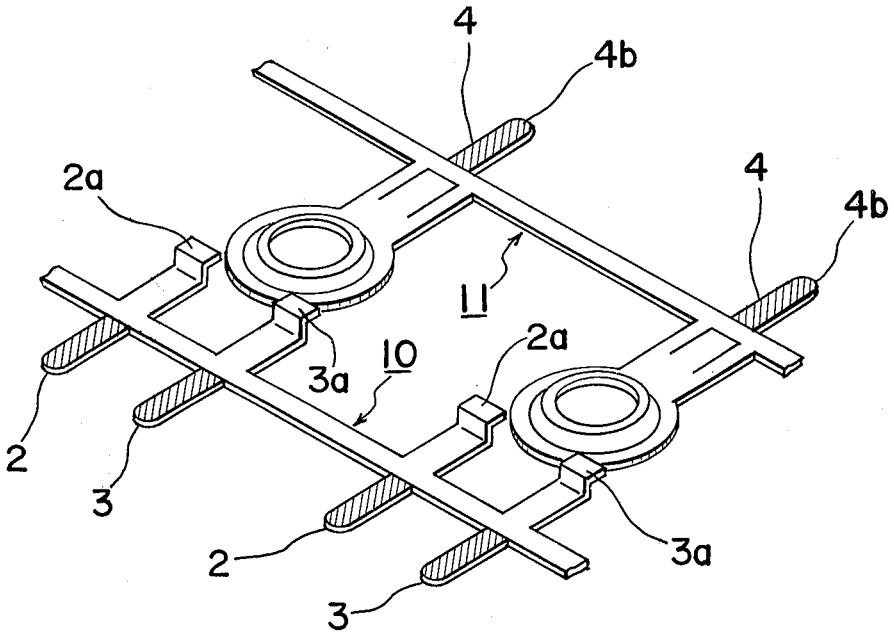
FIGS. 6 and 7 are views similar to FIGS. 2(*a*) and 2(*b*), which are particularly explanatory of further modifications of the process of manufacturing the variable resistor of FIG. 1(*a*).
Figure 7:
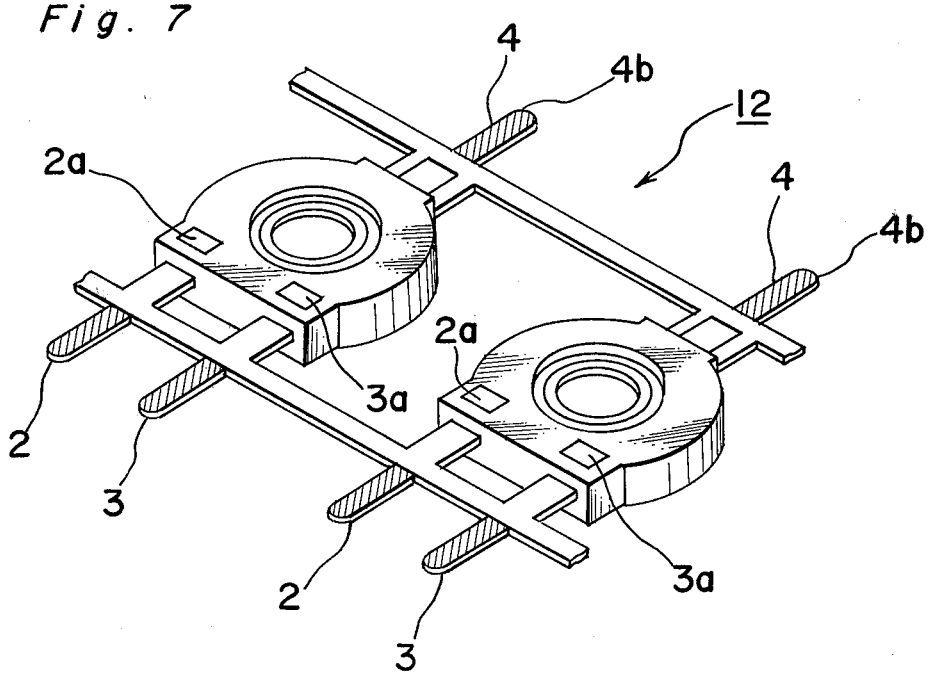

In further modifications of FIGS. 6 and 7, the variable side terminal portions 4*b* and the fixed side terminal portions 2 and 3 are subjected to the solder dipping (represented by hatched portions) in the state of the terminal frames 10 and 11 (FIG. 6) or in the state of the frame 12 on which the plurality of the substrates 1 are formed after the insert molding (FIG. 7).

It should be noted here that in the foregoing embodiment, although the annular portion 4*r* of the variable side terminal member 4 is described as also embedded in the resin substrate 1, the concept of the present invention is not limited in its application to such a construction alone, but the terminal at the variable side may be modified to be an independent separate terminal which is secured to the substrate, for example, by an eyelet or the like, or to be formed into other constructions within the scope. Similarly, the configuration of the slider may also be modified into any other suitable shapes.

As is clear from the foregoing description, the present invention has such effects that, in the terminal molded type variable resistor, a favorable solderability is imparted to the terminal members thereof through application of an inexpensive solder layer, without impairing the close adhesion of the resistant layer with respect to the substrate, especially to the exposed terminal portions.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed as included therein.

What is claimed is:

1. A variable resistor for use in electrical and electronic equipment which comprises a substrate and a pair of fixed side terminal members integrally molded in said substrate, each of said fixed side terminal members including a forward end portion that is exposed at a surface of said substrate, a resistant layer formed on the surface of said substrate and including opposite end portions that meet said exposed forward end portions of said fixed side terminals and at interfaces therebetween are in electrical contact therewith, a variable side terminal member provided on said substrate, a slider movably disposed on said substrate and electrically connected to said variable side terminal member for sliding movement over said resistant layer so as to adjust resistance of said variable resistor, each of said fixed side terminal members having a solder coating material thereon at predetermined portions thereof, each of said fixed side terminals being void of said solder coating material at the interface between its said exposed forward end portion and said resistant layer.

2. A variable resistor as claimed in claim 1, wherein said substrate is molded with electrically insulating resin such as epoxy resin.

3. A variable resistor as claimed in claim 1, wherein said fixed side terminal members of metallic material are applied with the solder coating material of Sn-Pb alloy except for said exposed end portions thereof and embedded in said substrate through insert-molding during the molding of said substrate, with terminal portions thereof for external connections extending outwardly from said substrate.

4. A variable resistor as claimed in claim 1, wherein said resistant layer is formed by carbon material baked onto the surface of said substrate in a predetermined configuration.

5. A variable resistor as claimed in claim 1, wherein said variable side terminal member of metallic material is entirely applied with the solder coating of Sn-Pb alloy and embedded in said substrate through insert-molding during the molding of said substrate, with a terminal portion thereof for external connection extending outwardly from said substrate.

6. A variable resistor as claimed in claim 1, wherein said variable side terminal member of metallic material is entirely applied with the solder coating of Sn-Pb alloy and secured to said substrate by a securing means.

7. A variable resistor as claimed in claim 1, wherein said slider has tongue pieces extending outwardly therefrom and folded for staking at an inner peripheral edge of an opening formed in said variable side terminal member so as to be electrically connected to said variable side terminal member and rotatably mounted on said substrate for sliding movement thereof over the resistant layer.

8. A variable resistor as claimed in claim 1, wherein the resistant layer is formed on said surface of the substrate by baking at a temperature above the melting point of said solder coating material.

9. A variable resistor as claimed in claim 1 wherein the resistant layer is formed on the one surface of the substrate by baking.

10. A variable resistor as claimed in claim 9 in which said fixed side terminal members are coated with said solder coating material except at their interfaces with said resistant layer.

11. A variable resistor as claimed in claim 10 wherein said substrate is molded with electrically insulating resin such as epoxy resin.

12. A variable resistor as claimed in claim 10, wherein said fixed side terminal members of metallic material are applied with the solder coating material of Sn-Pb alloy and embedded in said substrate through insert-molding during the molding of said substrate, with terminal portions thereof for external connections extending outwardly from said substrate.

13. A variable resistor as claimed in claim 10, wherein said variable side terminal member of metallic material is entirely applied with the solder coating of Sn-Pb alloy and embedded in said substrate through insert-molding during the molding of said substrate, with a terminal portion thereof for external connection extending outwardly from said substrate.

14. A variable resistor as claimed in claim 10, wherein said variable side terminal member of metallic material is entirely applied with the solder coating of Sn-Pb alloy and secured to said substrate by a securing means.

15. A variable resistor as claimed in claim 10, wherein said slider has tongue pieces extending outwardly therefrom and folded for staking at an inner peripheral edge of an opening formed in said variable side terminal member so as to be electrically connected to said variable side terminal member and rotatably mounted on said substrate for sliding movement thereof over the resistant layer.

16. A variable resistor as claimed in claim 12 in which said baking takes place at a temperature above the melting point of said solder coating material on said fixed side terminal members.

* * * * *